US008031892B2

(12) United States Patent
Andersen et al.

(10) Patent No.: US 8,031,892 B2
(45) Date of Patent: Oct. 4, 2011

(54) HEARING AID WITH ENHANCED HIGH FREQUENCY REPRODUCTION AND METHOD FOR PROCESSING AN AUDIO SIGNAL

(75) Inventors: Henning Haugaard Andersen, Birkerod (DK); Kristian Tjalfe Klinkby, Varlose (DK)

(73) Assignee: Widex A/S, Lynge (DK)

( * ) Notice: Subject to any disclaimer, the term of this patent is extended or adjusted under 35 U.S.C. 154(b) by 957 days.

(21) Appl. No.: 11/960,694

(22) Filed: Dec. 19, 2007

(65) Prior Publication Data

US 2008/0123886 A1 May 29, 2008

Related U.S. Application Data

(63) Continuation-in-part of application No. PCT/DK2005/000433, filed on Jun. 27, 2005.

(51) Int. Cl.
*H04R 25/00* (2006.01)

(52) U.S. Cl. ..... 381/316; 381/312; 381/320

(58) Field of Classification Search ..... 381/60, 381/67, 312, 314, 316, 317, 320, 321, 98
See application file for complete search history.

(56) References Cited

U.S. PATENT DOCUMENTS

| | | | | |
|---|---|---|---|---|
| 3,385,937 | A * | 5/1968 | Lafon | 381/316 |
| 4,220,160 | A * | 9/1980 | Kimball et al. | 600/528 |
| 4,843,623 | A | 6/1989 | Lafon et al. | |
| 5,014,319 | A | 5/1991 | Leibman | |
| 6,408,273 | B1 | 6/2002 | Quagliaro et al. | |

FOREIGN PATENT DOCUMENTS

| | | | |
|---|---|---|---|
| EP | 0 054 450 | A1 | 6/1982 |
| EP | 0054450 | A1 | 6/1982 |
| EP | 1 441 562 | A2 | 7/2004 |
| JP | 57055700 | A | 4/1982 |
| JP | 5316597 | A | 11/1993 |
| WO | WO 99/14986 | A1 | 3/1999 |

OTHER PUBLICATIONS

J. S. Walther, "A Unified Algorithm for Elementary Function", Spring Joint Computer Conference, 1971, pp. 379-385.
Japanese OA 2008-517317 Jan. 24, 2011 with English Translation.

* cited by examiner

*Primary Examiner* — Huyen D Le
(74) *Attorney, Agent, or Firm* — Sughrue Mion, PLLC

(57) ABSTRACT

A hearing aid (50) comprises means (55, 56, 57, 58) for reproducing frequencies above the upper frequency limit of a hearing impaired user. The hearing aid (50) according to the invention comprises means (55, 57) for transposing higher bands of frequencies from outside the upper frequency limit of a hearing impaired user down in frequency based on a detected frequency in order to coincide with a lower band of frequencies within the frequency range perceivable by the hearing impaired user. The transposing means (55, 57) comprise an adaptive notch filter (15) for detecting a dominant frequency in the lower band of frequencies, adaptation means (16) controlled by the adaptive notch filter (15), an oscillator (3) controlled by the adaptation means (16), and a multiplier (4) for performing the actual frequency transposition of the signal. The invention further provides a method for processing a signal in a hearing aid.

16 Claims, 8 Drawing Sheets

SPL
BPF1
BSS
2
4
6
8
10
12
f [kHz]

SPL
CGF
NFF
BSS

LSB
USB
2
4
6
8
10
12
f [kHz]

SPL

BL-
LSB
BPF2
RS
2
4
6
8
10
12
f [kHz]

HEARING AID WITH ENHANCED HIGH FREQUENCY REPRODUCTION AND METHOD FOR PROCESSING AN AUDIO SIGNAL

RELATED APPLICATIONS

The present application is a continuation-in-part of application No. PCT/DK2005/7000433; filed on Jun. 27, 2005, in Denmark and published as WO 2007/000161A1.

BACKGROUND OF THE INVENTION

1. Field of the Invention

This invention relates to hearing aids. More specifically it relates to hearing aids having means for altering the spectral distribution of the audio signals to be reproduced by the hearing aid. The invention further relates to methods for processing signals in hearing aids.

Individuals with a degraded auditory perception are in many ways inconvenienced or disadvantaged in life. Provided a residue of perception exists they may, however, benefit from using a hearing aid, i.e. an electronic device adapted for amplifying the ambient sound suitably to offset the hearing deficiency. Usually, the hearing deficiency will be established at various frequencies and the hearing aid will be tailored to provide selective amplification as a function of frequency in order to compensate the hearing loss according to those frequencies.

2. The Prior Art

However, there are individuals with a very profound hearing loss at high frequencies who do not gain any improvement in speech perception by amplification of those frequencies. These steeply sloping hearing losses are also referred to as ski-slope hearing losses due to the very characteristic curve for representing such a loss has in an audiogram. Hearing ability could be close to normal at low frequencies but decreases dramatically at high frequencies. Steeply sloping hearing losses are of the sensorineural type, which is the result of damaged hair cells in the cochlea. Some possible causes of steeply sloping hearing losses are: long-term exposure to loud sound (e.g. noisy work), temporary and very loud sounds (e.g. an explosion or a gunshot), lack of sufficient oxygen supply at birth, various types of hereditary disorder, certain rare virus infections, or possible side effect of certain types of strong medicine. Characteristic signs of steeply sloping hearing loss are the inability to perceive sounds in the high frequencies and a reduced tolerance to loud, high-frequency sounds (sensitivity to sound).

People without acoustic perception in the higher frequencies (typically from between 2-8 kHz and above) have difficulties regarding not only their perception of speech, but also their perception of other useful sounds occurring in a modern society. Sounds of this kind may be alarm sounds, doorbells, ringing telephones, birds singing, or they may be certain traffic sounds, or changes in sounds from machinery demanding immediate attention. For instance, unusual squeaking sounds from a bearing in a washing machine may attract the attention of a person with normal hearing so that measures may be taken in order to get the bearing fixed or replaced before fire or another hazardous condition occurs. A person with a profound high frequency hearing loss, beyond the capabilities of the latest state-of-the-art hearing aid, may let this sound go on completely unnoticed because the main frequency components in the sound lie outside the person's effective auditory range even when aided. No matter how powerful the hearing aid is, the high frequency sounds cannot be perceived by a person with no residual hearing sensation left in the upper frequencies. A method of conveying high frequency information to a person incapable of perceiving acoustic energy in the upper frequencies would thus be useful.

U.S. Pat. No. 5,014,319 proposes a digital hearing aid comprising a frequency analyzer and means for compressing the input frequency band in such a way that the resulting, compressed output frequency band lies within the perceivable frequency range of the hearing aid user. The purpose of this system, known as digital frequency transposition (DFC), is to enhance phonemes with significant high frequency content, especially plosives and diphthongs, in speech by compressing the upper frequency band in such a manner that the frequencies where the plosives and diphthongs occur are moved sufficiently downward in frequency to allow them to be perceived by a hearing impaired hearing aid user. The system is dependent on the characteristics in the incoming signal and the frequency analyzer in order to function properly. Other sounds in the upper frequency band are not detected by the frequency analyzer, and their frequencies are therefore not compressed and thus remain undetectable by the user. The frequency analyzer has to be very sensitive in order for phonemes to be correctly recognized. This puts a great strain on the hearing aid signal processor.

EP 1 441 562 A2 discloses a method for frequency transposition in a hearing aid. A frequency transposition is applied to the spectrum of a signal, using a nonlinear frequency transposition function so that all frequencies above a selected frequency $f_G$ are compressed in a nonlinear manner and all frequencies below the selected frequency $f_G$ are compressed in a linear manner. Although the lower frequencies are compressed in a linear manner in order to avoid transposition artifacts, the whole useable audio spectrum is nonetheless compressed, and this may lead to unwanted side effects and an unnaturally sounding reproduction. The method is also very processor intensive, involving FFT-transformation of the signal to and from the frequency domain.

U.S. Pat. No. 6,408,273 B1 discloses a method for providing auditory correction for hearing impaired individuals by extracting pitch, voicing, energy and spectrum characteristics of an input speech signal, modifying the pitch, voicing, energy and spectrum characteristics independently of each other, and presenting the modified speech signal to the hearing impaired individual. This method is elaborate and cumbersome, and appears to affect the sound image in a negative way because the entire perceivable frequency spectrum is processed. This kind of intensive processing inevitably distorts the overall sound image, perhaps even beyond recognition, and thus presents the user with perceivable, but unrecognizable, sound.

The methods of frequency transposition known in the prior art all affect the low frequency content of the processed signal in some form. Although these methods render high frequency components in the signal audible to persons with steep hearing losses, they also compromise the integrity of the overall signal, making a lot of well-known sounds hard to recognize with this system. In particular, the amplitude-modulated envelope of the input signal is deteriorated badly with any of the known methods. An effective, fast and reliable method for making high frequency sounds available to hearing impaired people, without compromising the quality of the result significantly, is thus desirable.

SUMMARY OF THE INVENTION

According to a first aspect of the invention, there is provided a hearing aid comprising an input transducer, a signal processor and an output transducer, said signal processor comprising means for splitting the signal from the input transducer into a first frequency part and a second frequency part, the first frequency part comprising signals at higher frequencies than signals of the second frequency part, a frequency detector for identifying a dominant frequency in the first frequency part, an oscillator controlled by said frequency detector, means for multiplying the signal from said first frequency part by an output signal from said oscillator, thereby creating a transposed signal falling within the frequency range of the second frequency part, means for superimposing the transposed signal onto the second frequency part in order to create a sum signal, and means for presenting the sum signal to the output transducer.

By the invention, sounds in a high frequency range are made available to the hearing-impaired user in a pleasant and recognizable way. Specifically, a pure tone is mapped to a pure tone, a sweep is mapped to a sweep, a modulated signal is mapped to an equally modulated signal, noise is mapped as noise, and the low frequency sound is preserved without distortion.

According to a second aspect of the invention, there is provided a hearing aid comprising an input transducer, a signal processor and an output transducer, said signal processor comprising means for splitting the signal from said input transducer into a first, a second and a third frequency parts, the first frequency part comprising signals at higher frequencies than signals of the second frequency part and of the third frequency part, the second frequency part comprising signals at higher frequencies than signals of the third frequency part, a first frequency detector for identifying a first dominant frequency in the first frequency part, a first oscillator controlled by said first frequency detector, and first multiplier means for multiplying the signal from said first frequency part by an output signal from said first oscillator, in order to create a first transposed signal falling within the frequency range of the third frequency part, a second frequency detector for identifying a second dominant frequency in the second frequency part, a second oscillator controlled by said second frequency detector, and second multiplier means for multiplying the signal from said second frequency part by an output signal from said second oscillator, in order to create a second transposed signal falling within the frequency range of the third frequency part, and means for superimposing said first transposed signal and said second transposed signal onto the third frequency part in order to create a sum signal.

The invention in a third aspect, provides a method for processing a signal in a hearing aid. Said method comprising the steps of acquiring an input signal, splitting the input signal into a first frequency part and a second frequency part, the first frequency part comprising signals at higher frequencies than the second frequency part, transposing the frequencies of the signals of the first frequency part creating a frequency-transposed signal falling within the frequency range of the second frequency part, superimposing the transposed signal on the second frequency part creating a sum signal, and presenting the sum signal to an output transducer. By applying the method to a signal with high-frequency content, the high-frequency content is shifted downward in frequency by a specified amount, rendering the signal with the high-frequency content audible to a person with a hearing impairment otherwise excluding the high-frequency content.

Consider dividing the useable audio frequency spectrum into two parts, namely one low-frequency part assumed to be perceivable unaided to a person suffering from a ski-slope hearing loss, and one high-frequency part assumed to be imperceivable to the hearing-impaired user. If the low-frequency part of the spectrum is preserved and the high-frequency part is transposed down in frequency by a fixed amount, e.g. an octave, so as to fall within the low-frequency part and added to the low-frequency part, the high-frequency information present in the high-frequency part is rendered perceivable without seriously altering the information already present in the low-frequency band.

The actual transposition or moving of the high frequencies may be carried out in a relatively simple manner by folding or modulating the high frequency signal with a sine or a cosine wave. The frequency of the sine or cosine wave may be a fixed frequency, or it may be derived from the signal. The transposed high-frequency part signal is then mixed with the low-frequency part for reproduction as a low-frequency audio signal.

BRIEF DESCRIPTION OF THE DRAWINGS

The invention will now be described in further detail in conjunction with several embodiments and the accompanying drawings, where.

DETAILED DESCRIPTION OF THE INVENTION

Figure 1:
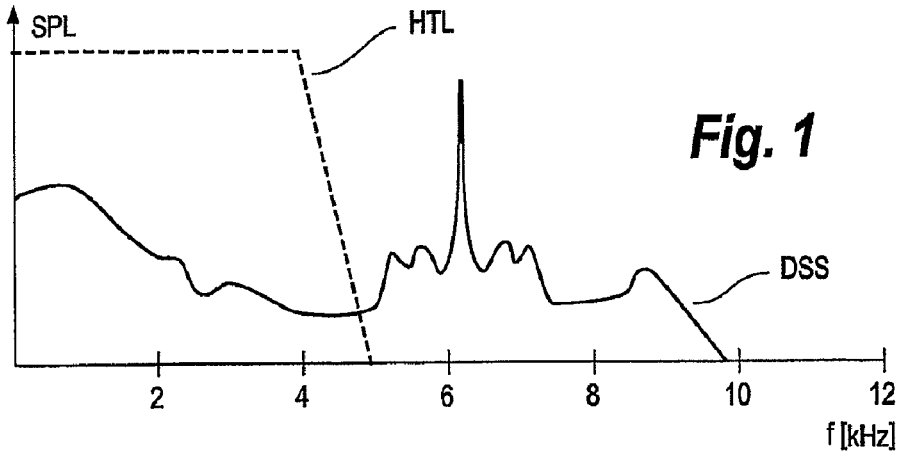
FIG. 1 is a graph showing an audio signal having frequency components beyond the limits of an assumed, impaired hearing capability.

FIG. 1 shows the frequency spectrum of an audio signal, denoted direct sound spectrum, DSS, comprising frequency components up to about 10 kHz. Between 5 and 7 kHz is a band of frequencies of particular interest, incidentally having a peak around 6 kHz. The assumed perceptual frequency response of a typical, so-called "ski-slope" hearing loss hearing curve, denoted hearing threshold level, HTL, is shown symbolically in the figure as a dotted line, indicating a normal hearing curve up to about 4 kHz but sloping steeply above 4 kHz. Sounds with frequencies above approximately 5 kHz cannot be perceived by a person with this assumed hearing curve.

Figure 2:
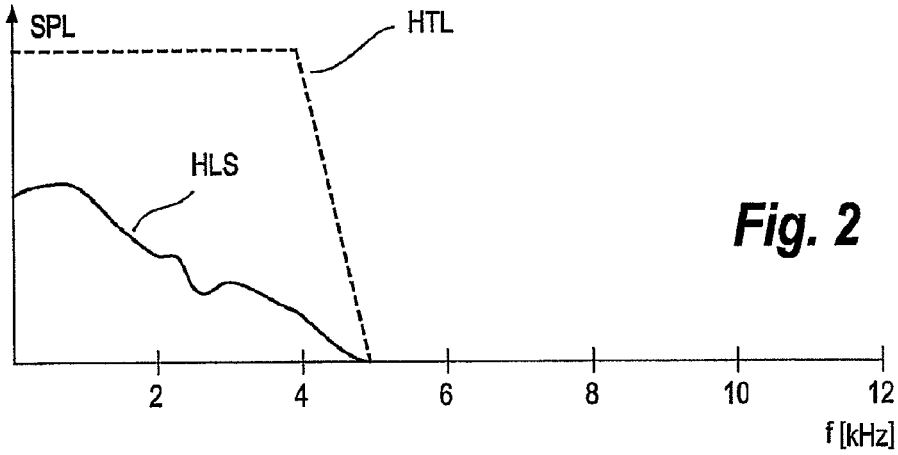
FIG. 2 is a graph showing the audio signal in FIG. 1 as perceived by the person with assumed impaired hearing capability.

FIG. 2 illustrates how the audio signal DSS, shown in FIG. 1, is perceived by a person with the particular assumed "ski-slope" hearing loss, HTL, shown in FIG. 2 as a dotted line.

The resulting perceived part of the frequency spectrum, denoted the hearing loss spectrum, HLS, is shown in a solid line below that. Sounds at frequencies below the sloping part of the hearing curve are perceived normally by the hearing impaired person in question, while sounds at frequencies above the sloping part of the hearing curve remain imperceivable, even with powerful amplification, as the hearing loss in this frequency band is so severe that there is no residual hearing capability there. This may be the situation if no remaining hair cells are left to sense vibrations in the part of the basilar membrane of the inner ear normally involved in the perception of these frequencies. Thus, an approach different from plain amplification of certain frequencies is needed to render perceivable the frequencies above the frequency limit according to this hearing curve.

Figure 3:
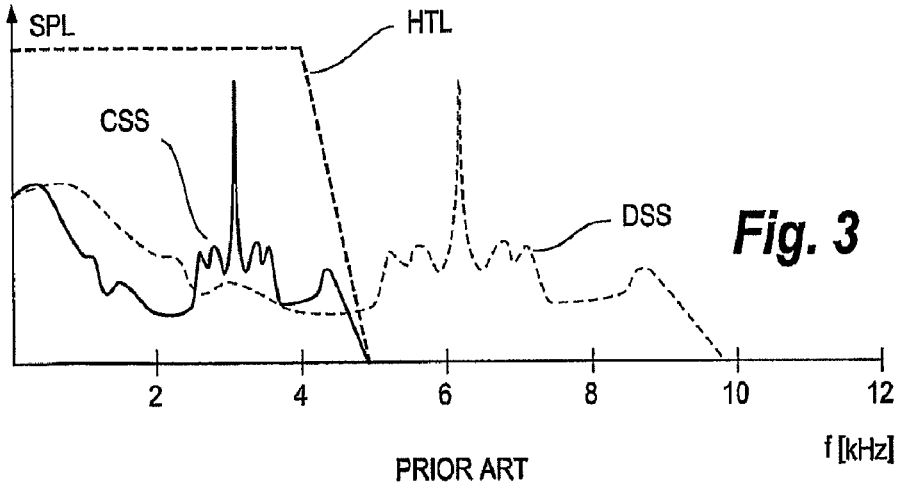
Fig. 3 PRIOR ART
FIG. 3 is a graph showing the method of frequency compression according to the prior art.

FIG. 3 is a graph showing the result of utilizing a prior art method which makes sounds at frequencies above the limits of a particular hearing range perceivable by compressing the audio frequency spectrum, DSS, for reproduction by a hearing aid so as to make the resulting frequency spectrum, denoted the compressed sound spectrum, CSS, fit to the limitations of a particular hearing loss, HTL. As may be learned from the graph, all frequency components of the original signal DSS up to about 10 kHz are hereby mapped within the range of the hearing impaired person's residual hearing HTL, but the resulting frequency spectrum CSS itself is severely distorted, in particular in the lower frequencies.

Although this method manages to convert high frequency sounds into perceptible sounds, the overall sound quality has been corrupted to a point where recognition of well-known sounds have become difficult or even downright impossible, and the reproduced sound's relationship with sounds perceived without the aid of the method is virtually non-existent. Perception of high frequencies is thus obtained at the cost of the ability to readily recognize otherwise well-known sounds. This ability could, of course, be restored through intensive training, but such training may be difficult to perform successfully, especially when dealing with elderly hearing aid users. Thus, compressing the entire frequency spectrum is not an optimum solution to the problem of making high-frequency sounds available to hearing-impaired hearing aid users.

Figure 4:
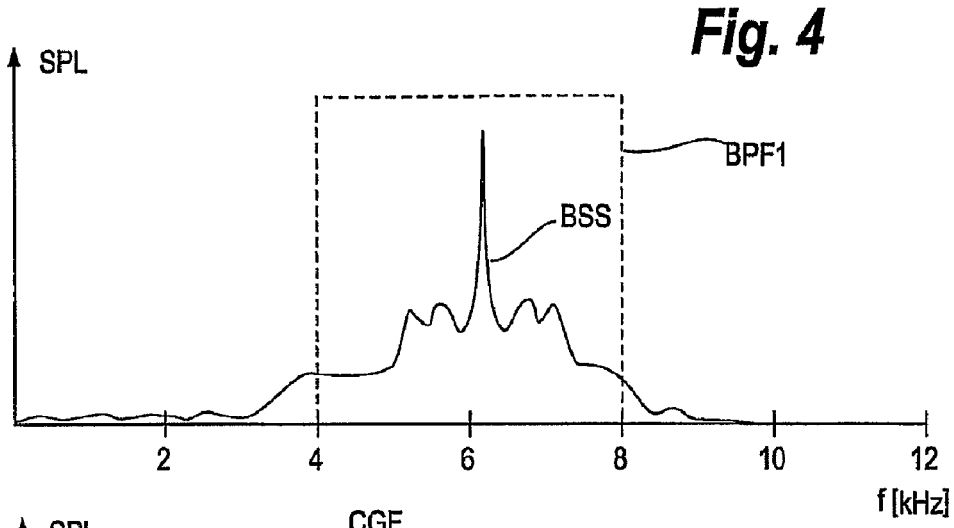
FIG. 4 is a graph showing a first step in the method of frequency transposition according to the invention.

FIG. 4 is a graph illustrating a first step in the method of the invention. Initially, a relationship between the high-frequency part and the low-frequency part has to be selected. This frequency relationship is preferably chosen as a simple ratio of e.g. 1/2 or 1/3, and is used in a later step in calculating the frequency utilized for transposition. For preparing the high-frequency part, the original audio signal DSS as shown in FIG. 1 has been band-limited, BSS, to span the frequency band from 4 kHz to 8 kHz, i.e. an octave, and is thus ready for analysis and transposing in the second and third step of the invention, shown in FIG. 5. The actual filtering is carried out using a first band-pass filter, denoted BPF1.

Figure 5:
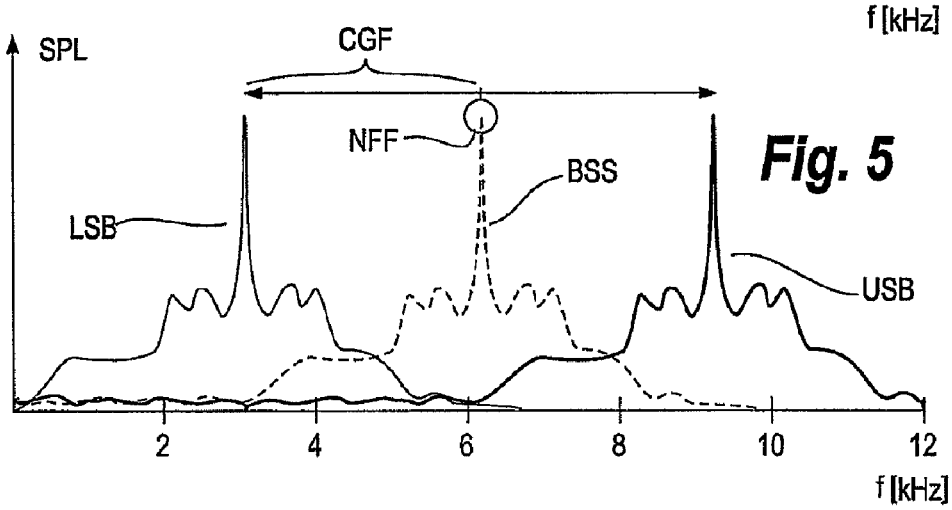
FIG. 5 is a graph showing a second step in the method of frequency transposition according to the invention.

FIG. 5 shows the graph of the band-limited signal, denoted the band-limited sound spectrum, BSS, from FIG. 4 in a dotted line. The band-limited audio signal BSS is analyzed for a dominant frequency, denoted notch filter frequency, NFF, which has in this example been identified by a circle on the BSS graph around 6 kHz. This analysis may be conveniently carried out using an adaptive notch filter that processes the band-limited audio signal and seek out that particular narrow band of frequencies in the band-limited signal having the highest sound pressure level, denoted SPL, at any given instant. The notch filter continuously adapts its notch frequency while attempting to minimize its output. When the notch filter is tuned to a dominant frequency, the total output from the notch filter is minimized. Once a dominant frequency, NFF, has been found in this way, a third step of the method of the invention is carried out, where the frequency with which to perform the actual transposition of the high-frequency signal part, BSS, denoted calculated generator frequency, CGF is calculated.

This frequency, CGF, is then, in a fourth step, multiplied with the band-limited high-frequency signal part BSS, creating an upper sideband, denoted USB, and a lower sideband, denoted LSB, copy of the signal, respectively, whereby the band-limited high-frequency part of the audio spectrum BSS, is transposed up and down in frequency. These signal parts, USB and LSB, are shown in FIG. 5 in solid lines. However, only the lower sideband signal part, LSB, is utilized. The oscillator frequency CGF is calculated by the formula:

$$CGF = \frac{N-1}{N} \cdot NFF$$

where CGF is the calculated oscillator frequency, NFF is the notch filter frequency, and N is the relationship between the source band and the target band.

This calculation is carried out continuously on the input signal BSS in order to adapt this step of the method to a constantly varying auditory environment where sound—along with its high-frequency content—is constantly changing.

This effectively takes a high-frequency band signal BBS and shifts it downwards in frequency by CGF, e.g. by 1/2 or 1/3 of the dominant frequency NFF. NFF is shifted exactly by e.g. one or two octaves while side lobes are shifted downwards in frequency alongside it. If, as often is the case, the high frequency signal is a series of harmonics of a fundamental tone in the low frequency band, the transposed signal will exhibit a series of harmonics consistent with any harmonics of the fundamental tone in the low frequency band.

Figure 6:
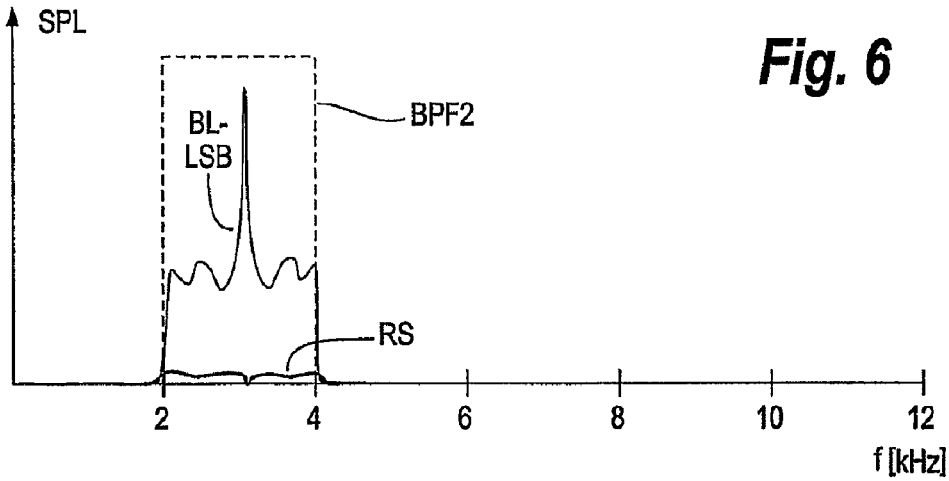
FIG. 6 is a graph showing a third step in the method of frequency transposition according to the invention.

In FIG. 6, a fifth step is carried out, whereby, the transposed, band-limited high-frequency part of the lower-sideband signal, denoted BL-LSB, is band-limited further by a second band-pass filtering, denoted BPF2, in order to single out the lower sideband, LSB, of FIG. 5 and make it fit within an octave in the low-frequency part (not shown), i.e. from 2 kHz to 4 kHz, discarding some side lobes of the transposed signal. The band-limiting filter graph BPF2 is shown in FIG. 6 in a dotted line, and the resulting, further band-limited high-frequency part of the signal, BL-LSB, is shown in a solid line.

Figure 7:
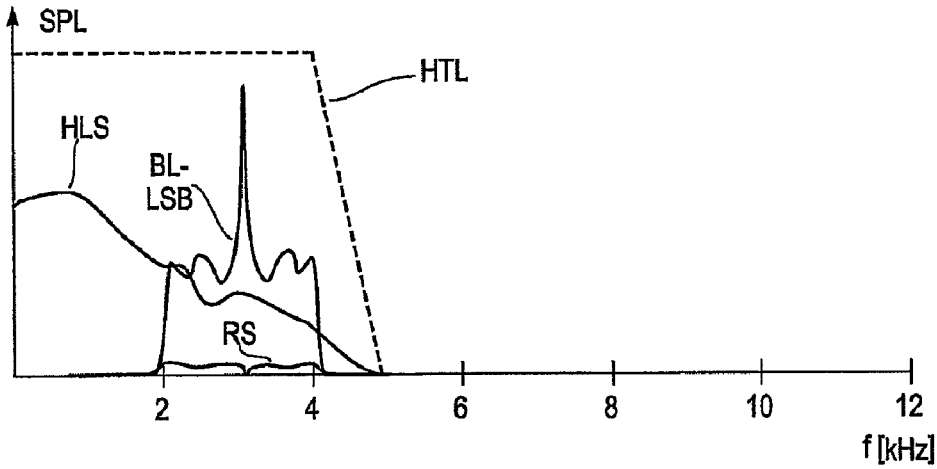
FIG. 7 is a graph showing the audio signal in FIG. 1 as perceived after application of the method of the invention.

In a sixth step, shown in FIG. 7, the transposed, band-limited high-frequency part of the signal BL-LSB is added to the low-frequency part of the signal, HLS, in effect making sounds in the high-frequency part of the audio spectrum audible to a person with a ski-slope hearing impairment, HTL, while rendering the low-frequency part unchanged. The hearing loss curve, HTL, is shown in a dotted line and the low-frequency part, HLS, and the transposed, band-limited high-frequency part of the signal, BL-LSB, are shown in solid lines. The combined signal parts are further processed by the hearing aid processor as appropriate in view of the user's hearing capability in the target range and presented by the output transducer (not shown). A significant benefit of this approach to the problem is the fact that the combined audio signal is immediately recognizable by a hearing impaired user without the need for any additional training.

Figure 8:
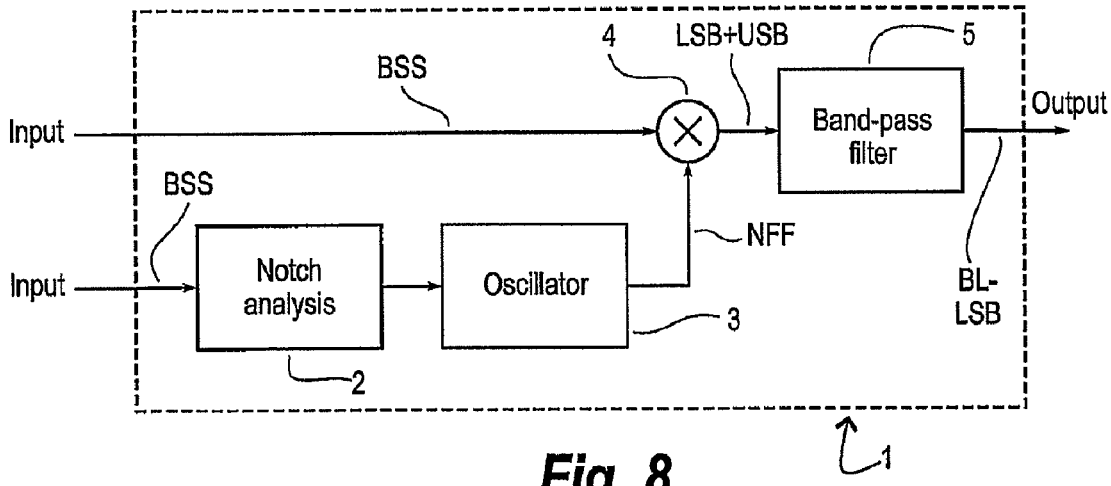
FIG. 8 is a block schematic of an implementation of the method in FIGS. 4, 5 and 6.

FIG. 8 is a block schematic of a preferred embodiment of the invention. A transposer block 1 comprises a notch analysis block 2, an oscillator 3, a multiplier 4 and a band-pass filter 5. The high-frequency part of the signal, similar in nature to the graph denoted BSS in FIG. 4, is presented to a first input of the multiplier 4 and to the input of the notch analysis block 2. The output of the notch analysis block 2 is connected to a frequency control input of the oscillator block 3, and the output of the oscillator block 3 is connected to a second input of the multiplier 4. The notch analysis block 2 performs a continuous dominant-frequency analysis of the input signal, giving a control signal value as its output for controlling the frequency of the oscillator 3.

The signal from the oscillator 3 is a single frequency, corresponding to the circle denoted NFF in FIG. 4, is multiplied to the signal BSS, whereby two transposed versions, LSB and USB, of the input signal BSS is generated. The output of the multiplier 4 is connected to the input of the band-pass filter 5, corresponding to the second band-pass filter curve BPF2 in FIG. 6. The output from the band-pass filter 5 is a signal resembling the curve BL-LSB in FIG. 6, i.e. a band-limited version of the transposed signal LSB in FIG. 5.

The frequency of the oscillator block 3 is controlled in such a way that the dominant frequency in the input signal detected by the notch analysis block 2 determines the oscillator frequency according to the expression $$f_{osc} = \frac{N-1}{N} \cdot f_{notch},$$

where N is the frequency relationship between the calculated oscillator frequency, $f_{osc}$, and the notch frequency, $f_{notch}$, detected in the source frequency band. The actual transposition is then carried out by multiplying the input signal with the output from the oscillator 3 in the multiplier 4. The transposed high-frequency signal is then band-limited by the band-pass filter 5 before leaving the transposer block 1. This band-limiting is carried out to ensure that the transposed signal will fit within an octave in the target frequency band.

Figure 9:
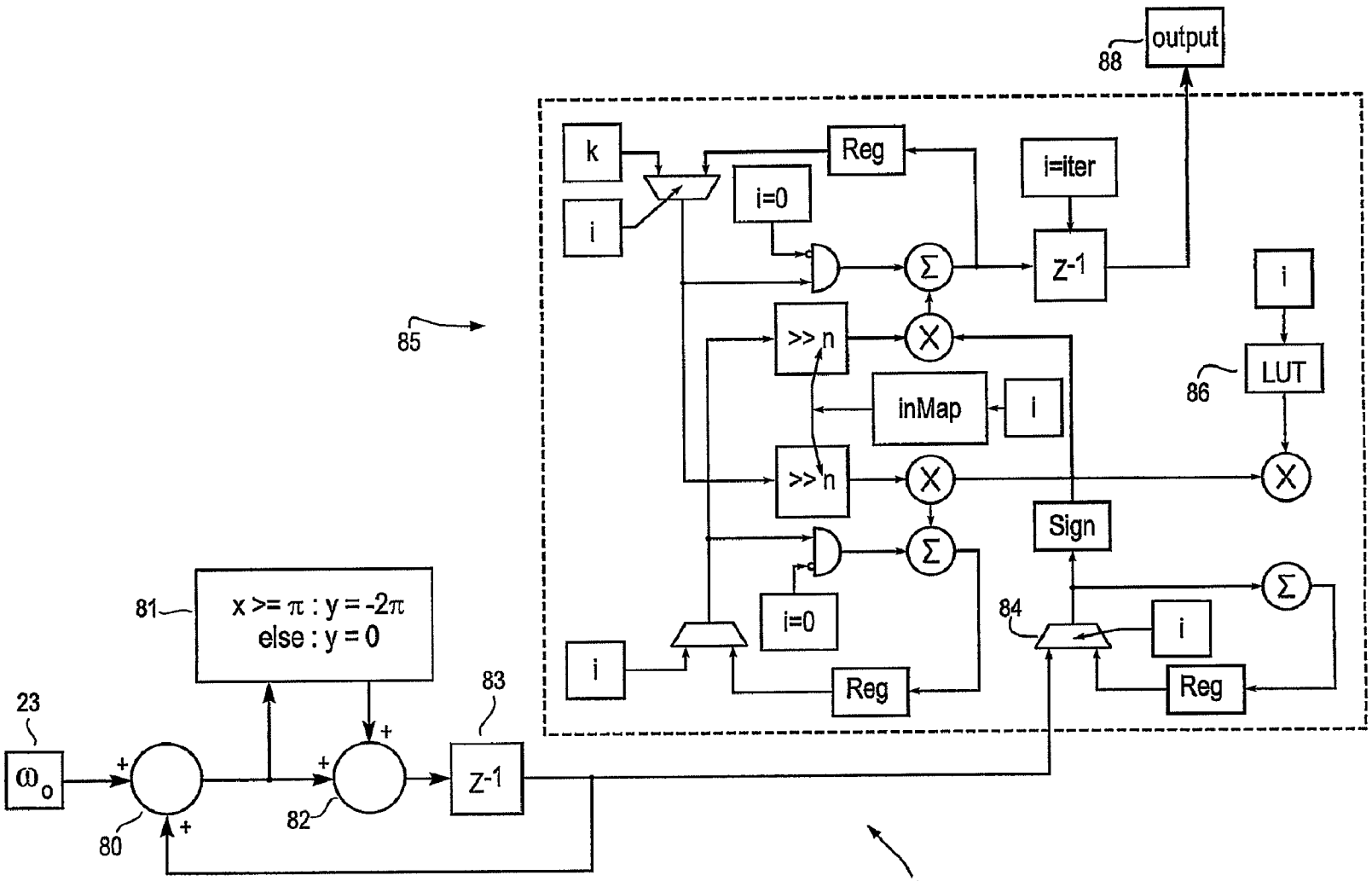
FIG. 9 is a schematic of an implementation of the oscillator block 3 in FIG. 8.

FIG. 9 shows a digital oscillator algorithm together with a CORDIC algorithm block 85 preferred for implementing a cosine generator 3 in conjunction with the invention as shown in FIG. 8. The operation and internal structure of the CORDIC algorithm is well documented, for instance J. S. Walther: "A unified algorithm for elementary functions", Spring Joint Computer Conference, 1971, Proceedings, pp. 379-385, and thus no detailed discussion of it is made in this application.

The digital cosine generator or oscillator 3 comprises a frequency parameter input 23, a first summation point 80, a first conditional comparator 81, a second summation point 82 and a first unit delay 83. The frequency controlling parameter ω originating from the parameter input 23 is added to the output of the first unit delay 83 in the first summation point 80. The output of the first summation point 80 is used as a first input for the second summation point 82 and the input of the first conditional comparator 81. Whenever the argument presented to the first conditional comparator 81 is greater than, or equal to, π, the output of the conditional comparator is −2π, in all other cases the output of the conditional comparator is 0.

The output signal from the first unit delay is essentially a saw-tooth wave, which, when presented to the input 84 of the CORDIC cosine block 85, makes the CORDIC cosine block 85 present a cosine wave at the output 88. The frequency parameter ω (in radians) thus effectively determines the oscillation frequency of the cosine oscillator 3 used to modulate the input signal in the transposer block 1 shown in FIG. 8.

Figure 10:
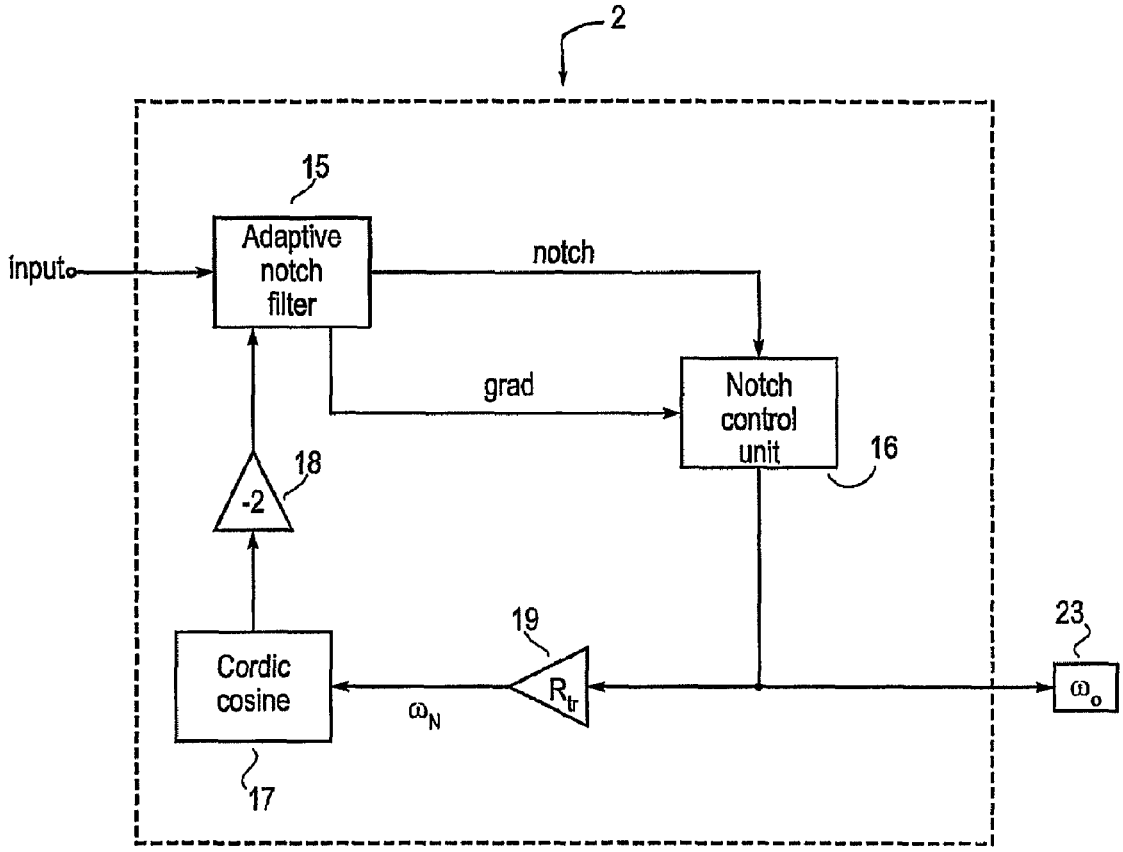
FIG. 10 is a block schematic of a digital implementation of the notch analysis block 2 in FIG. 8.

FIG. 10 is a schematic showing a digital embodiment of the notch analysis block 2 shown in FIG. 8 and configured for use with the invention. The notch analysis block 2 comprises an adaptive notch filter 15, a notch control unit 16, a CORDIC cosine block 17, a first constant multiplier 18 and a second constant multiplier 19, together forming a control loop, and an output value terminal 23.

The signal to be analyzed is presented to the signal input of the adaptive notch filter 15. The adaptation of the adaptive notch filter 15 is configured to search for and detect a dominant frequency in the input signal by constantly attempting to minimize the output of the notch filter 15, and it presents the detected frequency value as a notch parameter to a first input of the notch control unit 16 and the gradient value as a gradient parameter to a second input of the notch control unit 16.

The output of the notch control unit 16 is an update of the notch filter frequency prescaled by the factor $R_{tr}$ in the second constant multiplier 19 and the cosine of this parameter is calculated by the CORDIC cosine block 17, prescaled by the first constant multiplier 18, and presented to the control input of the adaptive notch filter 15. The prescaling factor $R_{tr}$ is calculated by:

$$R_{tr} = \frac{N}{N-1},$$

where N is the relationship between the oscillator frequency and the notch frequency, as described in the foregoing.

The output of the notch control unit is presented to the output 23 as the frequency parameter $\omega_o$. This is the frequency (in radians) used for transposing the input signal. For controlling the notch frequency $\omega_N$ of the adaptive notch filter 15, the output from the notch control unit 16 is scaled by a constant $R_{tr}$ in the second constant multiplier 19 before entering the CORDIC cosine block 17. The output of the notch analysis block 2 is thus, in effect, a dominant frequency of the input signal.

Figure 11:
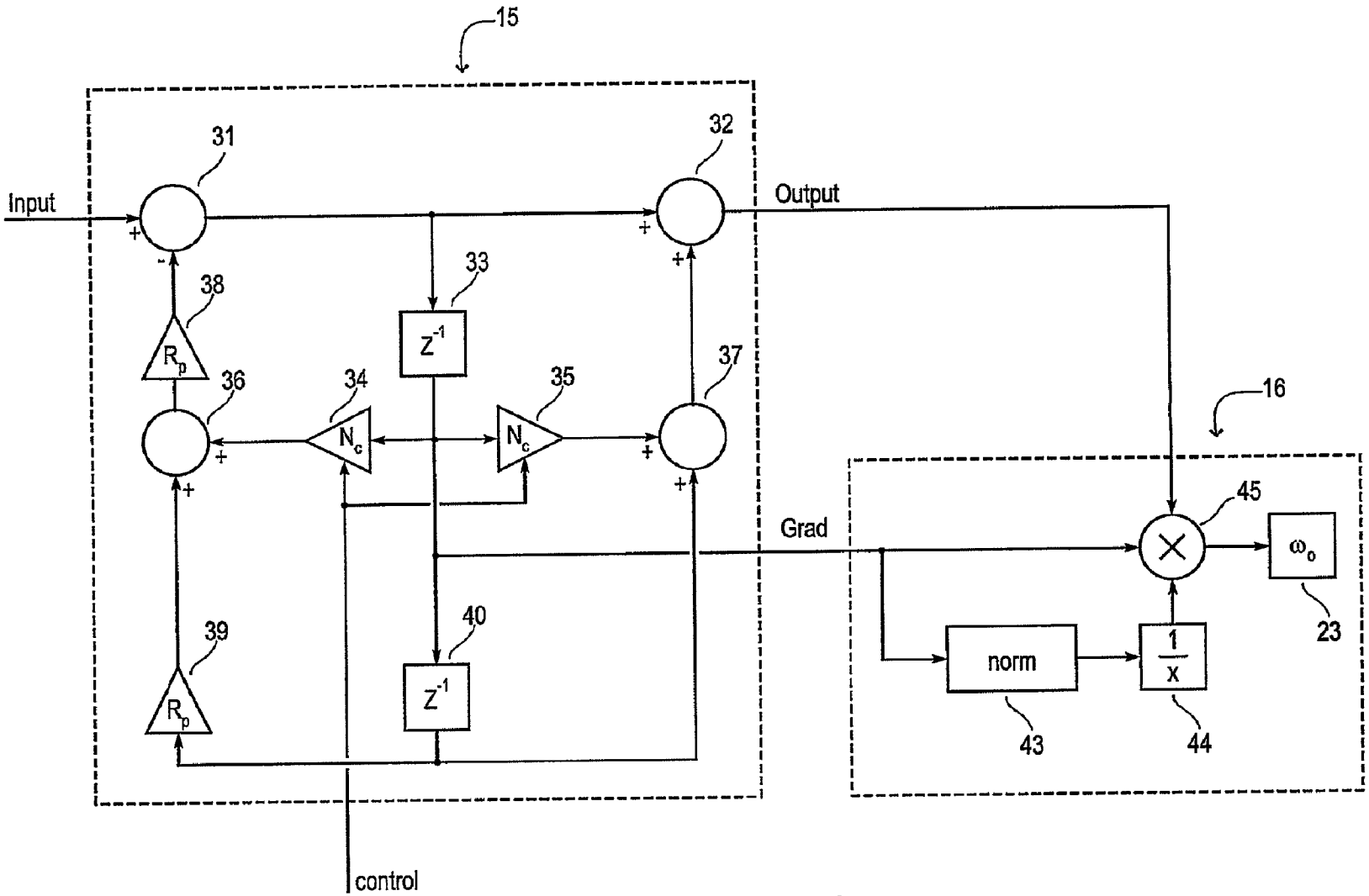
FIG. 11 is an embodiment of a notch filter and a notch control unit.

An embodiment of a notch filter 15 and a notch control unit 16 for use with the invention is shown in FIG. 11. The filter 15 is shown as a direct-form-2 digital band reject filter with a very narrow stop band. The filter 15 comprises a first summation point 31, a second summation point 32, a first unit delay 33, a first constant multiplier 34, a second constant multiplier 35, a third summation point 36, a fourth summation point 37, a third constant multiplier 38, a fourth constant multiplier 39, and a second unit delay 40. The notch control unit 16 comprises a normalizer block 43, a reciprocal block 44, a multiplier 45 and a frequency parameter output block 23.

The filter coefficients $R_p$ and $N_c$ provides notch-filter characteristics with two pass-bands separated by a rather narrow stop-band. The coefficient $R_p$ is the radius of the (double) pole of the notch filter 15, and the coefficient $N_c$ is the notch coefficient determining the center frequency of the stop-band of the notch filter 15. The value of $N_c$ is determined by the scaled and conditioned control value from the notch control unit 16 in FIG. 10, and is thus continuously updated in the first and second multipliers 34 and 35.

The notch filter 15 in FIG. 11 is configured to continuously trying to minimize its output by tuning the center frequency of the stop-band to coincide with a dominant frequency in the input signal. The gradient value from the notch filter 15 is output to the notch control unit 16 via the Grad output and is used by the notch control unit 16 to determine if the center frequency needs to be adjusted up or down in order to minimize the output signal. The notch filter 15 thus lets all but a narrow band of frequencies, determined by the center frequency, pass.

The notch control unit 16 uses the signals Grad and Output to form the frequency parameter $\omega_o$ according to the expression:

$$\omega_o(n+1) = \omega_o(n) + \mu \cdot \frac{\text{Output} \cdot \text{Gradient}}{norm(n)},$$

where $$\text{norm}(n) = \text{Max}(\text{norm}(n-1) \cdot \lambda, \text{Gradient}^2),$$

$\mu$ is the adaptation speed of the oscillator frequency to the notch frequency and $\lambda$ is the wavelength of the notch frequency. The parameter norm is defined as the larger of the two expressions. The output from the notch control unit 16 is the frequency parameter $\omega_o$ used for controlling the oscillator block 3 in FIG. 8.

A hearing aid user may, under certain circumstances, wish to be able to benefit from frequencies above the upper 8 kHz limit made available through application of the invention as described in the foregoing. However, if the transposition algorithm would be adapted to e.g. incorporate a wider frequency range, while still transposing frequencies above 8 kHz by a factor of two, this would result in transposed frequencies above the 2 kHz bandwidth limit of the system, which would not be reproduced after transposition. In a preferred embodiment a similar, second algorithm, working in parallel with the first, but taking as input the high-frequency range from 8 kHz to 12 kHz and transposing this range by a factor three, is employed, and the hearing aid user may then benefit from that frequency range, too. Such an additional algorithm does not interfere significantly with the transposition already carried out by the first algorithm.

Figure 12:
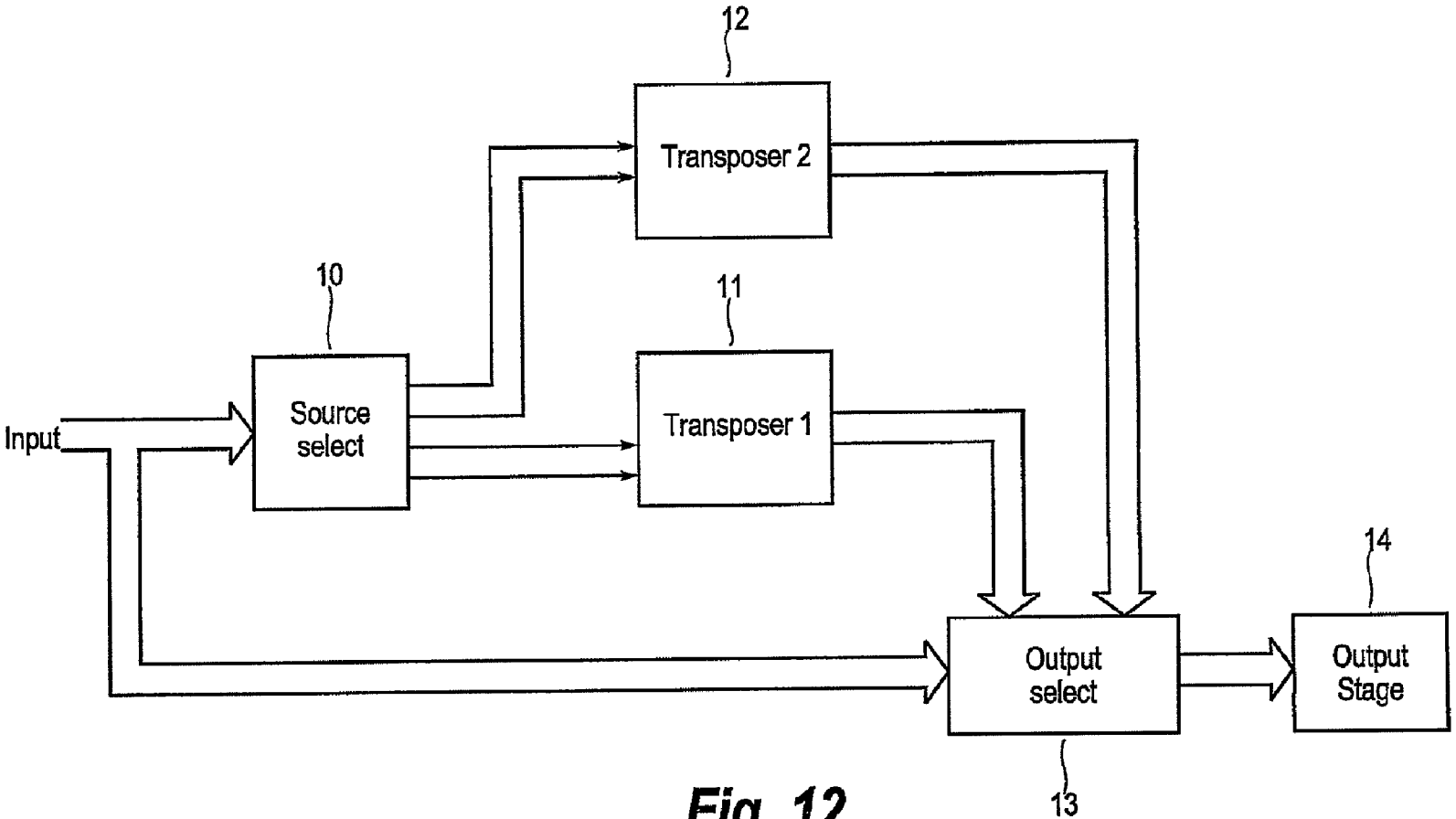
FIG. 12 is a block schematic of a transposer algorithm involving two separate transposer blocks.

An embodiment of a system to perform a multi-band transposition is shown in FIG. 12. The system shown in FIG. 12 comprises a source selection block 10, a first transposer block 11, a second transposer block 12, an output selection block 13 and an output stage 14. The four outputs of the source selection block 10 are connected to the inputs of the first transposer block 11 and the second transposer block 12, respectively. Both the outputs of the first transposer block 11 and the second transposer block 12 are connected to a second and a third input of the output selection block 13, and the output of the output selection block 13 is connected to the input of the output stage 14.

The input signal is split into a set of high-frequency bands and a set of low-frequency bands. The low frequency bands are passed directly to a first input of the output selection block 13, and the high frequency bands are passed to the input of the source selection block 10. The lower frequency bands contain the frequencies from approximately 20 Hz to approximately 4 kHz. The source selection block 10 has three settings; OFF, where no signal is passed to the transposer blocks 11, 12; LOW, where the input signal is passed on to the first transposer block 11 only; and HIGH, where the input signal is passed on to both the first transposer block 11 and the second transposer block 12.

The first transposer block 11 works in the frequency range from 4 kHz to 8 kHz, transposing the input signal down by a factor of two in order to give the transposed output signal a frequency range from 2 kHz to 4 kHz. The second transposer block 12 works in the frequency range from 8 kHz to 12 kHz, transposing the input signal down by a factor of three in order to give the transposed output signal a frequency range from about 2.6 kHz to 4 kHz. The output from the two transposer blocks 11, 12 is sent to the output selection block 13, where the balance between the level of the unaltered signal and the levels of the transposed signals from the transposer blocks 11, 12 is determined. The mixed signal, having a bandwidth from 20 Hz to 4 kHz, leaves the output selection stage 13 and enters the output stage 14 for further processing. Thus, the two transposer blocks 11, 12 work in tandem in order to render the frequency range from 4 kHz to 12 kHz audible to a hearing impaired person with an accessible frequency range limited to 4 kHz.

Figure 13:
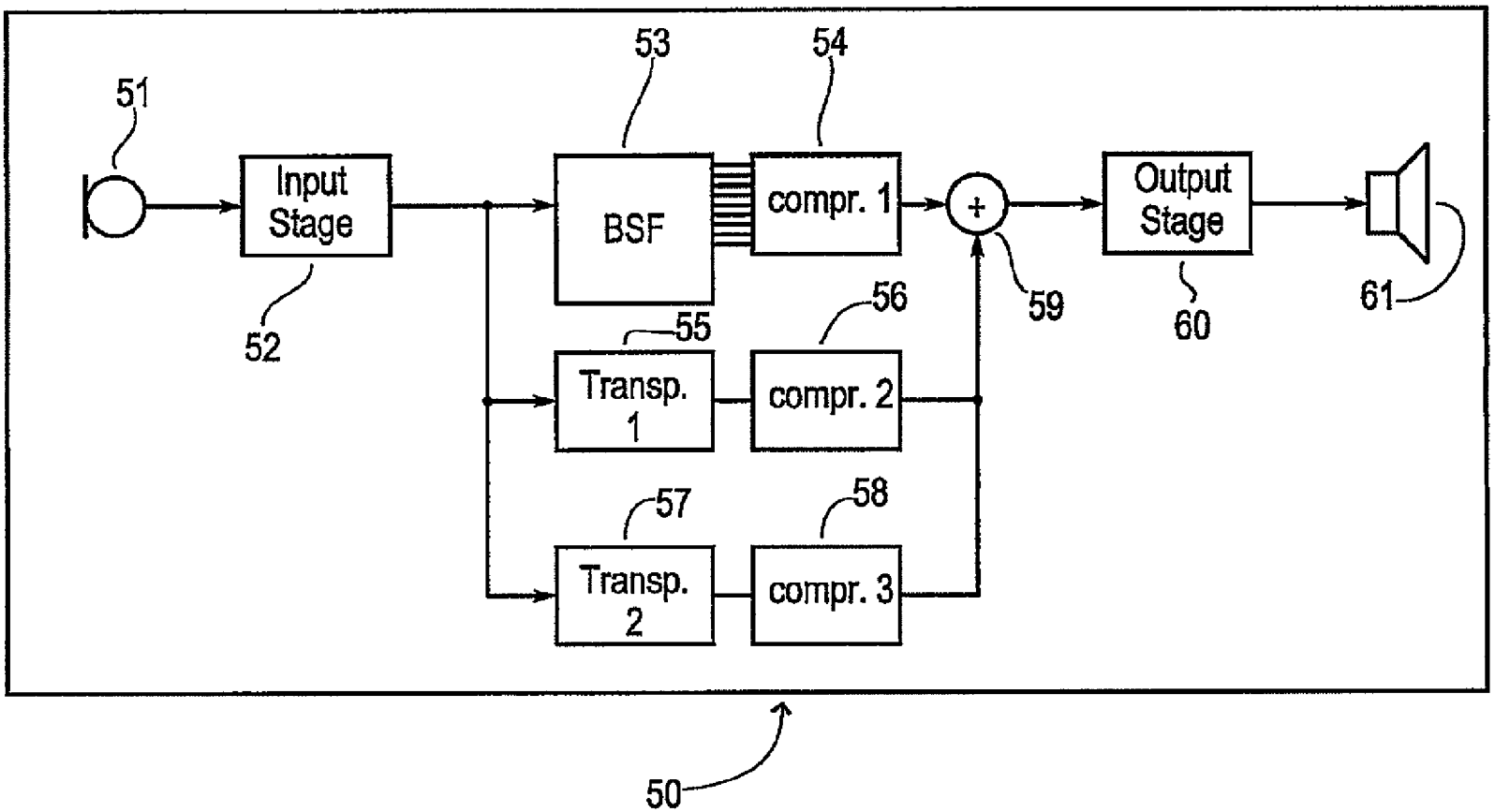
FIG. 13 is a block schematic of a hearing aid according to the invention.

FIG. 13 shows a hearing aid 50 comprising a microphone 51, an input stage block 52, a band-split filter block 53, a first transposer block 55, a second transposer block 57, a first compressor block 54, a second compressor block 56, a third compressor block 58, a summation point 59, an output stage block 60, and an output transducer 61. This is an embodiment of the invention wherein the output signals from the separate transposer blocks 55, 56 are subjected to further processing, e.g. compression in the compressors 56, 58 prior to summing the signals from the transposer blocks with the un-transposed signal portions in the summation point 59, prior to entering the output stage 60.

Sound is picked up by the microphone 51 and presented to the input stage block 52 for conditioning. The output from the input stage block 52 is used as an input to the band-split filter 53, the first transposer block 55, and the second transposer block 57. The band-split filter 53 splits the input signal into a plurality of frequency bands below a selected frequency limit, and each frequency band is compressed separately by the first compressor block 54. The first transposer 55 transposes a first frequency band above said selected frequency limit down in frequency so as to fit within the bands below said selected frequency limit, and the second compressor block 56 compresses the transposed signal from the first transposer 55 separately. In a similar manner, the second transposer 57 transposes a second frequency band above said selected frequency limit down in frequency so as to fit within the bands below said selected frequency, and the third compressor block 58 also compresses the transposed signal from the second transposer 57 separately.

The transposed, compressed signals from the second and third compressors 56, 58, are added to the low-pass filtered, compressed signal from the first compressor 54 in the summation point 59. The resulting signal, comprising only frequencies up to the selected frequency, is then processed by the output stage 60 and reproduced as an acoustic signal by the output transducer 61.

The input signal, comprising frequencies above and below the selected frequency, is thus treated in such a way by the hearing aid 50 that the output signal solely comprises frequencies below the selected frequency, the original frequencies below the selected frequency being reproduced without frequency alteration, and the original frequencies above the selected frequency being transposed down in frequency according to the invention so as to be reproduced coherently with the frequencies below the selected frequency.

A range of source bands, target bands and transposition factors may be made available in alternate embodiments according to the nature of particular hearing loss types and desired frequency ranges. The frequency ranges proposed in the foregoing should be regarded as exemplified ranges only, and not as limiting the invention in any way.

We claim:

1. A hearing aid comprising an input transducer, a signal processor and an output transducer, said signal processor comprising means for splitting the signal from the input transducer into a first frequency part and a second frequency part, the first frequency part comprising signals at higher frequencies than signals of the second frequency part, a frequency detector for identifying a dominant frequency in the first frequency part, an oscillator controlled by said frequency detector, means for multiplying the signal from said first frequency part by an output signal from said oscillator, thereby creating a transposed signal falling within the frequency range of the second frequency part, means for superimposing the transposed signal onto the second frequency part in order to create a sum signal, and means for presenting the sum signal to the output transducer.

2. The hearing aid according to claim 1, wherein the means for presenting the sum signal to the output transducer comprises an output stage adapted for conditioning the sum signal so as to compensate a hearing deficiency of a hearing aid user.

3. The hearing aid according to claim 1, comprising a first compressor for compressing the second frequency part, and a second compressor for compressing the transposed signal.

4. The hearing aid according to claim 1, wherein said means for splitting the signal from the input transducer into a first frequency part and a second frequency part comprises bandpass filter means for passing a frequency passband that includes said dominant frequency and for suppressing signals outside said passband.

5. The hearing aid according to claim 1, wherein said detector comprises a notch filter.

6. The hearing aid according to claim 1, wherein said oscillator is a cosine oscillator.

7. A hearing aid comprising an input transducer, a signal processor and an output transducer, said signal processor comprising means for splitting the signal from said input transducer into a first, a second and a third frequency parts, the first frequency part comprising signals at higher frequencies than signals of the second frequency part and of the third frequency part, the second frequency part comprising signals at higher frequencies than signals of the third frequency part, a first frequency detector for identifying a first dominant frequency in the first frequency part, a first oscillator controlled by said first frequency detector, and first multiplier means for multiplying the signal from said first frequency part by an output signal from said first oscillator, in order to create a first transposed signal falling within the frequency range of the third frequency part, a second frequency detector for identifying a second dominant frequency in the second frequency part, a second oscillator controlled by said second frequency detector, and second multiplier means for multiplying the signal from said second frequency part by an output signal from said second oscillator, in order to create a second transposed signal falling within the frequency range of the third frequency part, and means for superimposing said first transposed signal and said second transposed signal onto the third frequency part in order to create a sum signal.

8. A method for processing a signal in a hearing aid, said method comprising the steps of acquiring an input signal, splitting the input signal into a first frequency part and a second frequency part, the first frequency part comprising signals at higher frequencies than the second frequency part, detecting a first dominant frequency in the first frequency part, driving an oscillator at said the dominant frequency, and multiplying the signal of said first frequency part by the output signal from the oscillator, so as to create a frequency-transposed signal falling within the frequency range of the second frequency part, superimposing the transposed signal on the second frequency part creating a sum signal, and presenting the sum signal to an output transducer.

9. The method according to claim 8, comprising conditioning the sum signal to be presented to the output transducer in order to compensate a hearing deficiency of a hearing aid user.

10. The method according to claim 8, comprising compressing the second frequency part in a first compressor, and compressing the frequency-transposed signal in a second compressor.

11. The method according to claim 8, wherein the step of splitting the input signal into a first frequency part and a second frequency part comprises passing a first frequency passband that includes said dominant frequency and suppressing signals outside said first frequency passband.

12. The method according to claim 8, comprising selecting for the second frequency part a bandwidth that is smaller than the bandwidth of the first frequency part.

13. The method according to claim 8, comprising selecting for the second frequency part a bandwidth that is a fraction of the bandwidth of the first frequency part.

14. The method according to claim 8, comprising selecting for the second frequency part a bandwidth adapted to be perceptible to a hearing impaired user of the hearing aid.

15. The method according to claim 8, comprising transposing the second frequency part by an offset frequency computed as a fraction of the dominant frequency.

16. The method according to claim 8, comprising detecting a first dominant frequency in the first frequency part, passing a first frequency passband that includes said first dominant frequency and suppressing signals outside said first frequency passband, detecting a second dominant frequency in the second frequency part, passing a second frequency passband that includes said second dominant frequency and suppressing signals outside said second frequency passband, and selecting for transposition said first and said second frequency passbands.

* * * * *